United States Patent [19]

McGowan

[11] Patent Number: 5,067,294

[45] Date of Patent: Nov. 26, 1991

[54] PARTITION ASSEMBLY

[76] Inventor: Bruce McGowan, 101 Creek Rd., Andover, N.J. 07821

[21] Appl. No.: 532,622

[22] Filed: Jul. 30, 1990

[51] Int. Cl.[5] ..... E04H 1/00; E04B 2/78

[52] U.S. Cl. ..... 52/241; 52/239; 52/242; 52/282

[58] Field of Search ..... 52/239, 241, 242, 656, 52/36, 238.1, 281, 282

[56] References Cited

U.S. PATENT DOCUMENTS

| | | | |
|---|---|---|---|
| 1,065,758 | 6/1913 | Woodwell . | |
| 1,354,983 | 10/1920 | Lloyd . | |
| 1,368,646 | 2/1921 | Morrow . | |
| 2,393,514 | 1/1946 | Bicknell . | |
| 2,568,390 | 9/1951 | Gehrke . | |
| 3,174,592 | 3/1965 | Berman et al. | 52/36 X |
| 3,312,025 | 4/1967 | Deakins | 52/239 |
| 3,327,440 | 6/1967 | Watkins | 52/239 |
| 3,370,389 | 2/1968 | Macaluso | 52/239 |
| 3,486,287 | 12/1969 | Guillon | 52/282 X |
| 3,566,561 | 3/1971 | Tozer | 52/242 X |
| 3,738,073 | 6/1973 | Boulanger . | |
| 3,768,222 | 10/1973 | Birum, Jr. . | |
| 3,854,269 | 12/1974 | Hancock . | |
| 3,967,427 | 7/1976 | Piget . | |
| 4,035,972 | 7/1977 | Timmons | 52/36 X |
| 4,090,799 | 5/1978 | Crotti et al. | 52/656 X |
| 4,123,879 | 11/1978 | Blodee et al. | 52/241 |
| 4,485,597 | 12/1984 | Worrallo | 52/36 |
| 4,914,878 | 4/1990 | Tamaki et al. | 52/36 X |
| 4,962,805 | 10/1990 | Allen | 52/239 X |
| 4,976,080 | 12/1990 | Zegel et al. | 52/239 |

*Primary Examiner*—John E. Murtagh
*Assistant Examiner*—Deborah McGann Ripley
*Attorney, Agent, or Firm*—Thomas L. Adams

[57] ABSTRACT

A partition assembly has a hollow post with an upper open end. The assembly includes a panel having an edge recess and a post clip mounted in the recess for releasably attaching to the hollow post. The assembly also has a top spanner having a central prong sized to fit into the upper open end of the hollow post. This spanner has a pair of panel clips oppositely positioned about the central prong. Each of the panel clips are operable to releasably attach to the top of the panel.

18 Claims, 2 Drawing Sheets

FIG. 2
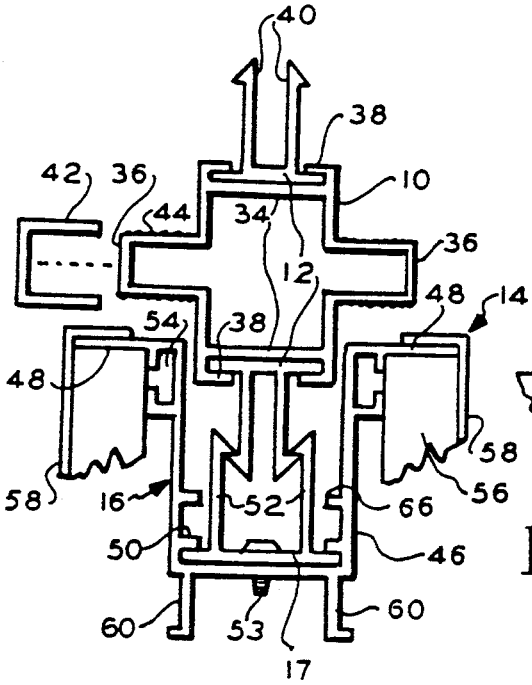
FIG. 4
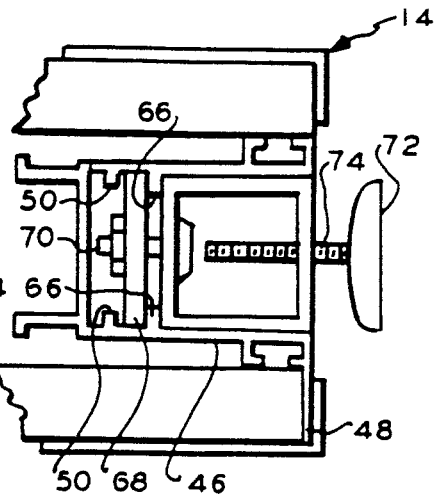
FIG. 5
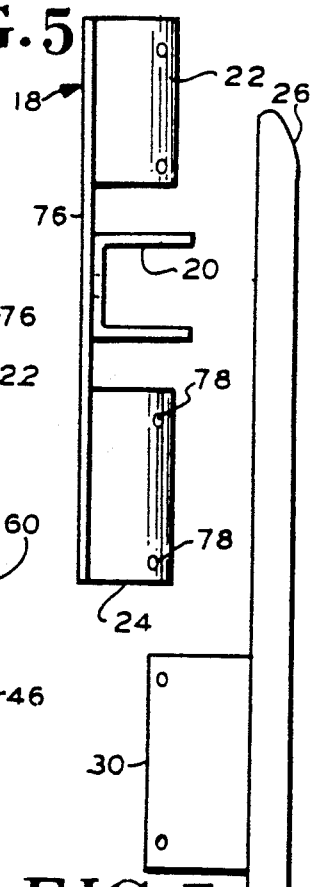
FIG. 6
FIG. 3
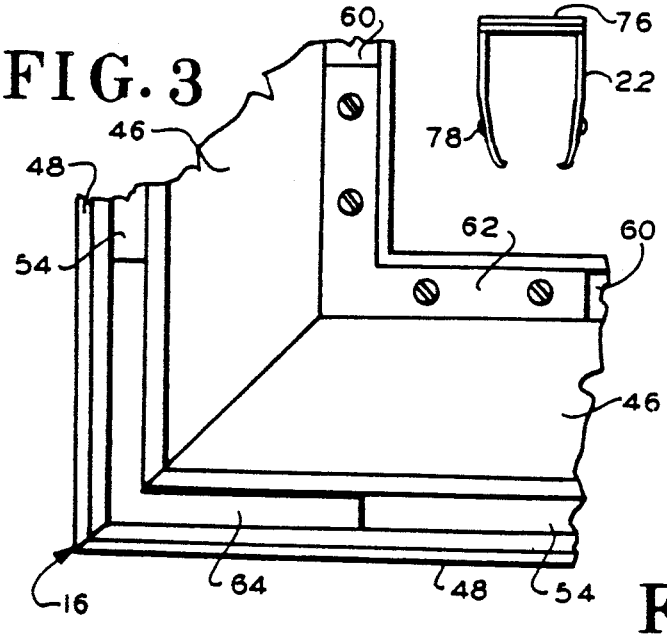
FIG. 7

PARTITION ASSEMBLY

BACKGROUND OF THE INVENTION

The present invention relates to a partition assembly and, in particular, to panels that can be connected together through an intermediate post.

It is known to divide an office floor by using quickly assembled partitions. These partitions are free standing and therefore do not become part of the real estate. Often these panels do not reach the ceiling of the office. These known partitions include a post having four or more positions into which a panel can be attached. It is know to attach a decorative cap atop the intermediate post. A disadvantage with known partition assemblies is the difficulty of assembling them, as well as the lack of sufficient structural rigidity.

The following U.S. Pat. Nos. show partition assemblies and fastening hardware: 1,065,758; 1,354,983; 1,368,646; 2,393,514; 2,568,390; 3,370,389; 3,738,073; 3,768,222; 3,854,269; and 3,967,427.

Accordingly, there is a need for an improved partition assembly, which is rigid and easily assembled.

SUMMARY OF THE INVENTION

In accordance with the illustrative embodiments demonstrating features and advantages of the present invention, there is provided a partition assembly having a hollow post with an upper open end. The assembly has a panel with an edge recess and a post clip mounted in the recess for releasably attaching to the hollow post. The assembly has a spanner with a central prong sized to fit into the upper open end of the hollow post. This spanner has a pair of panel clips oppositely positioned about the central prong. Each of the panel clips can releasably attach to the top of the panel.

By employing equipment of the foregoing type, an improved partition assembly is achieved. In a preferred embodiment, a post has a cruciform shape with two wings that project outwardly and are perforated to allow mounting of shelf brackets, for example. The post also has two other wings with grooved ridges. The grooved ridges can hold a barbed frame clip designed to mate with a barbed post clip in an edge recess of the panel. The edges of the panel are defined by a frame, preferably formed of extrusions. The frame has an U-shaped midsection with shelves that engage flanges on the above mentioned post clip.

The post is quickly assembled to the panel by thrusting together the post clip and frame clip. After these are locked together, a spanner plate having an U-shaped prong is inserted into the open top end of the post. On this spanner plate, U-shaped clips snap into the recess on the top edge of the panel so that the top of the post is locked between the post and the two panels.

The recessed midsection of the frame extrusions also have an internal ledge that can abut a hollow square beam. The beam can be bolted to the ledge using a backup slat on the other side of the ledge. Adjustable supporting feet can be threadably attached to the beam. In the preferred embodiment, the extrusions of the frame have projections that can encircle a facade such as decoratively covered wood or particle board.

The frame extrusions can have a 45° miter cut and be joined at right angles to form a rectangular frame. The frame extrusions can preferably have slots or tracks into which right angle brace plates or brackets are mounted. The frame can be made rigid when the right angle plates or brackets are slid into the appropriate slot, and, optionally, screwed into place.

BRIEF DESCRIPTION OF THE DRAWINGS

The above brief description as well as other objects, features and advantages of the present invention will be more fully appreciated by reference to the following detailed description of presently preferred but nontheless illustrative embodiments in accordance with the present invention when taken in conjunction with the accompanying drawings wherein:

FIG. 2 is an end view of a post attached to the frame extrusion of FIG. 1;

FIG. 3 is an inside plan view of the miter joint between the frame extrusions of the panel of FIG. 1;

FIG. 4 is an end view of the bottom most edge of the frame extrusion in the panel of FIG. 1;

FIG. 5 is a side view of the spanner of FIG. 1;

FIG. 6 is an end view of one of the panel clips of FIG. 5;

FIG. 7 is a partial side view of an end cap from FIG. 1; and

DETAILED DESCRIPTION OF THE PREFERRED EMBODIMENTS

Figure 1:
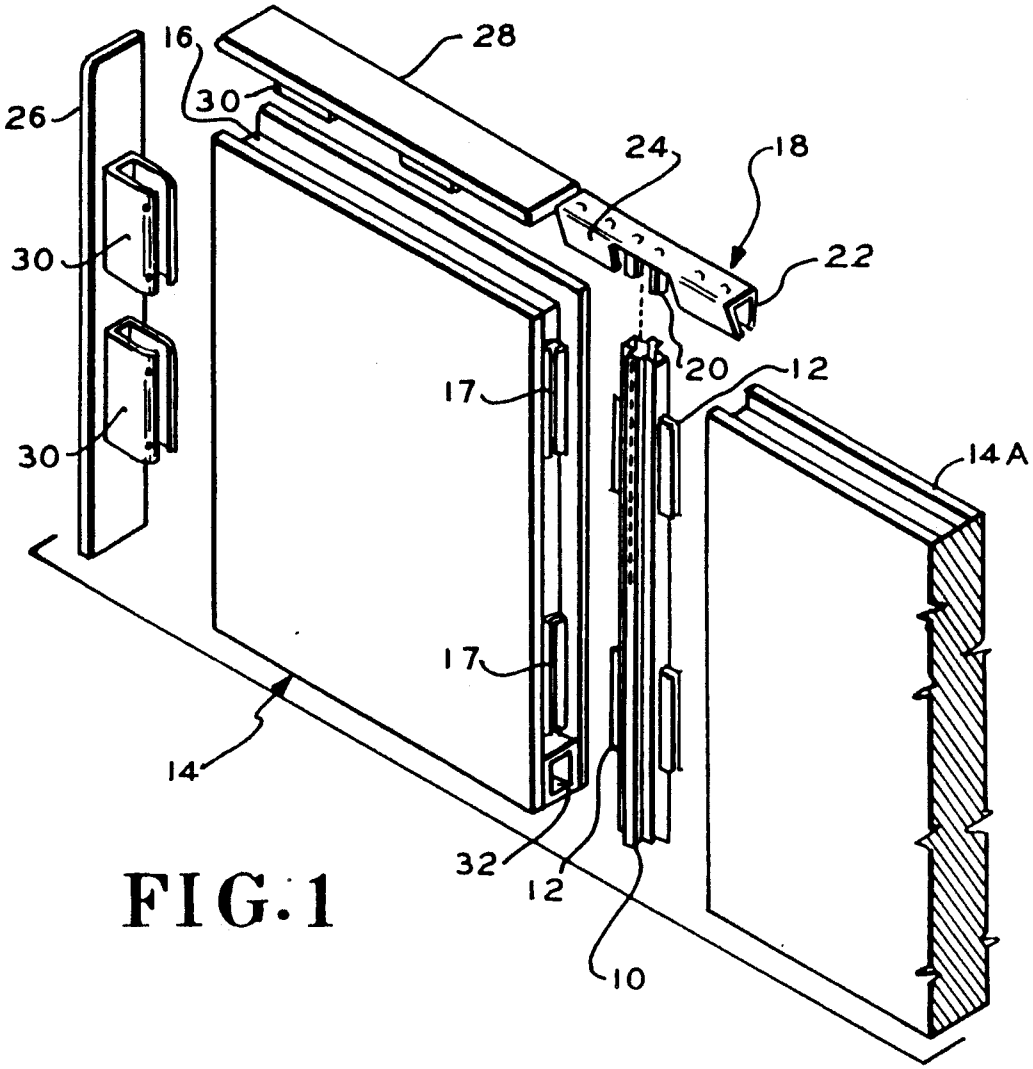
FIG. 1 is an exploded perspective view of the partition assembly of the present invention.

Referring to FIG. 1, a partition assembly is shown comprising a hollow post 10 having a cruciform cross section. On opposite wings of post 10, are two pairs of frame clips 12.

Panel 14 is shown with a rectangular frame 16 having an edge recess. A pair of post clips 17 are shown mounted in the vertical recess of frame 16 at a position to engage the frame clips 12. End caps 26 and 28 are each shown with a pair of cap clips 30 sized to fit within the recess of rectangular frame 16. A lower beam 32 is shown mounted in the lowermost recess of frame 16.

A spanner 18 is shown having a center prong 20 in the form of an inverted U-shaped clip mounted between a pair of panel clips 22 and 24 having an inverted U-shape. Prong 20 and clips 22 and 24 are shaped to fit into the top of post 10 and the edge recess of frame 16, respectively.

Referring to FIG. 2, previously mentioned post 10 is shown having a cruciform cross section with a pair of connecting wings 34 and perforated wings 36 for mounting shelf brackets. Mounted on the outside of connecting wings 34 are two pairs of opposing ridges 38. Each pair of ridges 38 are sized to hold the flanges of frame clips 12 by their flanges. As shown in this view, frame clips 12 have a parallel pair of outwardly barbed legs 40.

A decorative cap 42 fits over the perforated wing 36 when it is unencumbered with shelves. Cap 42 can be a plastic channel. The sides of wings 34 have saw tooth ridges to keep caps 42 in place.

Previously mentioned rectangular frame 16 is shown as an extruded aluminium channel 46 having a U-shaped midsection and outward projections 48. Channel 46 is symmetrical about a central plane. A pair of rails 60 inwardly projecting from the rear side of channel 46 form a pair of tracks 60. Inside the midsection of channel 46 are a pair of parallel opposite shelves 50, spaced from the floor of the channel to grasp the flanges of post clip 17. Post clip 17 is shown having a pair of inwardly barbed legs 52. Post clip 17 is shown screwed to the floor of channel 46 with self tapping screw 53.

At the inside corners made by projections 48 there are a pair of rails forming a slot 54. These rails forming slot 54 also act as an abutment for supporting facade 56, which is made of wood, particle board, styrofoam or other materials appropriate for decorative purposes. In this embodiment, facade 56 is covered with a fabric 58.

Referring to FIG. 3, previously mentioned frame 16 is shown employing a pair of channels 46 that are joined at a 45° miter joint. The channels 46 are laid so that the slot 54 and track 60 merge together and form two right angle paths. A right angle bracket 62 is shown screwed into track 60 to hold channels 46 together. A right angle brace plate 64 is shown slipped into slot 54 to provide additional rigidity for the miter joint.

Referring to FIG. 4, previously mentioned bottom beam 32 is occupying the midsection of channel 46. Beam 32 is a hollow square beam resting on parallel ledges 66 that mounted on opposing inside faces of the mid section of channel 46 above shelves 50. A slat 68 is slipped between ledges 66 and shelves 50. The beam 32 is shown bolted to slat 68 by means of nut and bolt 70, although other fastenings means are possible. A pair of feet depend from beam 32, one such foot, foot 72, is a disk mounted on threaded stem 74. Stem 74 is threaded into the underside of beam 32 to allow height adjustment and leveling of beam 32.

Referring to FIG. 5, previously mentioned spanner 18 is shown having a rectangular top plate 76. In some embodiments where a right angle joint is made between panels, plate 76 can have a similar right angle bend. Previously mentioned prong 20 is shown herein as an inverted U-shaped clip sized to fit within the upper opening of the previously mentioned post (post 10 of FIG. 2). Panel clips 22 and 24 are shown welded to the lower faces of top plate 76. As shown in FIG. 6, clip 22 has an inverted U-shape with rolled edges having nubs 78. Nubs 78 are designed to snap over the ledges of the frame (ledges 66 of FIG. 2).

Referring to FIG. 7, an edge view is given of previously mentioned end cap 26. In this embodiment, cap 26 can be a wooden or plastic decorative molding. Previously mentioned cap clip 30 is screwed to end cap 26. The cross section of clip 30 is similar to that shown in FIG. 6 except that the clip legs are slightly longer.

Figure 8:
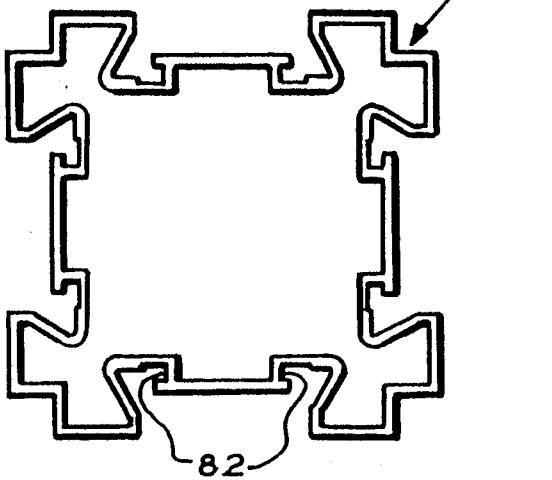
FIG. 8 is an end view of a corner post designed to connect at right angles two of the posts of FIG. 1.

In FIG. 2 ridges 38 of post 10 hold frame clips 12 at positions 180° apart. In some embodiments, however, walls must be joined at a 90° angle. The hollow connecting standard 80 of FIG. 8 can perform such a connection. Standard 80 is an extrusion having four identical faces spaced 90° apart. Each of these faces have a recess containing a pair of parallel grooves 82. Grooves 82 are shaped to engage ridges 38 (FIG. 2) on post 10. While a four sided structure is shown in FIG. 8, in some embodiments, fewer or more faces can be employed to allow positioning partitions at various angles.

To erect the partition assembly of FIG. 1, the panel 14 is placed in position and panel clips 12 of post 10 are thrust into post clips 17. Thereafter, an adjacent panel 14A having similar post clips (not illustrated) are thrust onto panel clips 12 on the opposite face of post 10. Thereafter, spanner 18 is thrust down with its prongs 20 entering the upper open end of post 10. Simultaneously, panel clips 22 and 24 snap into the recesses of frame 16. Finally, decorative end caps 26 and 28 are snapped into the recessed edges of frame 16 by means of cap clips 30.

It is to be appreciated that various modifications may be implemented with respect to the above described preferred embodiments. For example, the channel comprising the frame can have varying thickness and depths depending upon the size and desired structural rigidity. Furthermore, the dimensions of the panel and post clips can be altered and other locking mechanism may be employed other than barbed legs. To accommodate differently sized and shaped post and frame clips, the shelves within the midsection of the frame extrusions can be altered accordingly. Also, the post can be sized to accommodate various sized panels. In addition, the post can be rearranged to allow angled connections between the panels. The post can be shaped to provide a right angle corner or corners of various angles. Also, the beam supporting the feet can be of various shapes and, in some embodiments, no feet will be used at all. Additionally, the spanner can have various lengths depending upon the desired structural rigidity between adjacent panels. Furthermore, the center prong of the spanner can be a solid post or a hollow beam having four sides or other shapes that will fit into the open top of the post. Also, clips shown with rolled, nubbed edges can be altered to roll in different directions, have barbs or may be altered in various ways to accomplish clipping.

Obviously many modifications and variations of the present invention are possible in light of the above teachings. It is therefore to be understood that within the scope of the appended claims, the invention may be practiced otherwise than as specifically described.

What is claimed is:

1. A partition assembly comprising:

a hollow post having an upper open end;

a panel having an exterior facade, an edge recess and a post clip, said post clip being mounted in an intermediate position extending along a predetermined interval of said recess, said interval being separated from the ends of said recess, said post clip being operable to releasably attach to said hollow post by thrusting together said panel and said post without lifting said panel and without removing said exterior facing from said panel, said panel being sized to rest on its bottom without bearing down upon said post; and a spanner having a central prong sized to fit into said upper open end of said hollow post, said spanner having a pair of panel clips oppositely positioned about said central prong, each of said panel clips being operable to releasably attach to the top of said panel, said panel clips being spaced from said post clip.

2. A partition assembly according to claim 1 wherein said panel comprises:

a rectangular frame comprised of four channels attached at four corners, each of said channels having a recessed midsection with a U-shaped cross-section providing said recess.

3. A partition assembly according to claim 2 wherein said channel has a pair of parallel, opposite shelves mounted inside said recessed midsection, said post clip having a pair of flanges mounted under said opposite shelves.

4. A partition assembly according to claim 3 wherein said post has two pairs of parallel, internally grooved ridges, one pair of said ridges projecting from one face of said post, the other pair of said ridges projecting from another face of said post, said assembly further comprising:

a frame clip having a pair of flanges mounted into the grooves between one pair of said ridges, said frame clip being shaped to snap onto said post clip.

5. A partition assembly according to claim 4 wherein each of said four channels has mitered joints and wherein said channel has (a) a pair of parallel, outward projections at opposite edges of said recessed midsection, and (b) a pair of slots at the inside corner formed at each juncture of said projections with said recessed midsection, said assembly comprising:

four pairs of right angle brace plates, each pair being mounted in said slots at a corresponding mitered joint between a corresponding pair of said channels.

6. A partition assembly according to claim 5 wherein said channel has a pair of tracks on opposite sides of said midsection of said channel, each of said tracks being spaced inwardly from and parallel to said slots, said assembly comprising:

four pairs of right angle brackets, each pair being mounted in said tracks at a corresponding mitered joint between a corresponding pair of said channels.

7. A partition assembly according to claim 6 further comprising:

a facade mounted between the projections of the channels of said frame.

8. A partition assembly according to claim 7 wherein said post clip includes a pair of inwardly barbed legs, and wherein said frame clip includes a pair of outwardly barbed legs.

9. A partition assembly according to claim 4 wherein said post has a cruciform cross-section with a pair of connecting faces having said two pairs of ridges, and with a pair of perforated faces adapted to support removable brackets.

10. A partition assembly according to claim 1 wherein said spanner includes a top plate centrally supporting said prong, said prong having an inverted U-shape.

11. A partition assembly according to claim 10 wherein said panel clips have an inverted U-shape with inwardly rolled and nubbed edges.

12. A partition assembly according to claim 3 wherein said channel has a pair of parallel, opposite ledges mounted inside said recessed midsection parallel to and outwardly from said shelves, said assembly comprising:

a slat mounted between said shelves and said ledges in the midsection of the lowermost one of said channels; and a beam attached to said slat and fitted in the midsection of the lowermost one of said channels on the outside of said ledges.

13. A partition assembly according to claim 12 further comprising:

a pair of feet attached to the underside of said beam.

14. A partition assembly according to claim 8 wherein said post has a cruciform cross-section with a pair of connecting faces having said two pairs of ridges, and with a pair of perforated faces adapted to support removable brackets.

15. A partition assembly according to claim 14 wherein said spanner includes a top plate centrally supporting said prong, said prong having an inverted U-shape, and wherein said panel clips have an inverted U-shape with inwardly rolled and nubbed edges.

16. A partition assembly according to claim 15 wherein said channel has a pair of parallel, opposite ledges mounted inside said recessed midsection parallel to and outwardly from said shelves, said assembly comprising:

a slat mounted between said shelves and said ledges in the midsection of the lowermost one of said channels; and a beam attached to said slat and fitted in the midsection of the lowermost one of said channels on the outside of said ledges.

17. A partition assembly according to claim 16 further comprising:

an end cap; and a cap clip attached to said end cap and having a U-shape with inwardly rolled and nubbed edges sized to fit into said midsection of said channel.

18. A partition assembly according to claim 17 further comprising:

a standard having at least two angularly spaced pairs of parallel grooves sized to engage the parallel ridges on said post, so that more than one of said posts and their panels can be held at an angle.

* * * * *